US007180417B2

(12) United States Patent
Matoba et al.

(10) Patent No.: US 7,180,417 B2
(45) Date of Patent: Feb. 20, 2007

(54) DISPLAY DEVICE

(75) Inventors: Kazuaki Matoba, Tokyo (JP); Yoshinori Sawata, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 603 days.

(21) Appl. No.: 10/679,405

(22) Filed: Oct. 7, 2003

(65) Prior Publication Data

US 2004/0201477 A1 Oct. 14, 2004

(30) Foreign Application Priority Data

Apr. 10, 2003 (JP) ..... P2003-105960

(51) Int. Cl.
*G08B 13/14* (2006.01)

(52) U.S. Cl. ..... 340/568.1; 340/568.2; 340/568.8; 340/571; 340/693.3; 340/426; 340/937; 71/57.1

(58) Field of Classification Search ..... 340/568.1, 340/568.2, 571, 693.3, 568.8, 426, 937; 70/57.1
See application file for complete search history.

(56) References Cited

U.S. PATENT DOCUMENTS 5,578,991 A * 11/1996 Scholder ..... 340/571
5,760,690 A * 6/1998 French ..... 340/571
5,767,771 A * 6/1998 Lamont ..... 340/571
6,531,961 B2 3/2003 Matsudaira

FOREIGN PATENT DOCUMENTS

JP 2-253395 A 10/1990
JP 8-249546 A 9/1996
JP 2001-283337 A 10/2001

* cited by examiner

*Primary Examiner*—Tai Nguyen
(74) *Attorney, Agent, or Firm*—Birch, Stewart, Kolasch & Birch, LLP

(57) ABSTRACT

A display device body includes an image display section for displaying an image, a first power supply section for supplying power to the image display section, an anti-theft section for preventing the display device body from theft, and a second power supply section for supplying power to the anti-theft section. The anti-theft section includes a vibration sensor for sensing a shake of the display device body, a vibration detection section for detecting a vibration based on an output level from the vibration sensor, a state retention section for selectively retaining one of a cautionary state in which caution is taken against the theft of the display device and an alarming state indicating that the display device is being stolen, an alarm section for issuing an alarm when the state retention section is in the alarming state, and an operation control section.

10 Claims, 10 Drawing Sheets

DISPLAY DEVICE

This nonprovisional application claims priority under 35 U.S.C. § 119(a) on Patent Application No. 2003-105960 filed in JAPAN on Apr. 10, 2003, which is herein incorporated by reference.

BACKGROUND OF THE INVENTION

1. Field of the Invention

The present invention relates to a display device with anti-theft capability.

2. Description of the Background Art

Conventionally, a common countermeasure for protecting a display device from theft has been to link a base for supporting the display device and a display device body together or link a wall or floor near the location of the display device and the display device body together by a chain, wire or the like. However, such an anti-theft measure limits the location of the display device and also requires a fixture for fixing the chain or wire in addition to the chain or wire, to result in the lack of convenience. As alternatives to the above-mentioned countermeasures, there have been proposed a tag-type anti-theft device for attachment to a display device as disclosed in Japanese Patent Application Laid-Open No. 2-253395 (1990) (Pages 3–5, FIG. 1), and an anti-theft mechanism incorporated in a display device body to be protected from theft as disclosed in Japanese Patent Application Laid-Open No. 8-249546 (1996) (Pages 2–3, FIG. 1).

However, the tag-type anti-theft device for attachment to the display device as disclosed in Japanese Patent Application Laid-Open No. 2-253395 is intended to prevent a customer from bringing a commodity out of the store without permission. This requires the size reduction of the tag-type anti-theft device so as not to obstruct the commodity. Such a requirement makes it difficult to incorporate a maintenance capability into the tag-type anti-theft device.

SUMMARY OF THE INVENTION

It is an object of the present invention to provide a display device with anti-theft capability which is excellent in convenience, operability and maintainability.

According to the present invention, a display device includes an image display section, a first power supply section, an anti-theft section and a second power supply section. The image display section presents a display based on an image signal. The first power supply section supplies power to the image display section. The anti-theft section prevents the display device from theft. The second power supply section is provided independently of the first power supply section, and supplies power to the anti-theft section. The anti-theft section includes a vibration sensor, a vibration detection section, a state retention section, an alarm section, and an operation control section. The vibration sensor senses a shake of the display device. The vibration detection section makes a comparison between an output level from the vibration sensor and a previously determined reference level to detect the presence or absence of a vibration. The state retention section selectively retains a cautionary state in which caution is taken against theft of the display device and an alarming state indicating that the display device is being stolen. The state retention section makes a transition from the cautionary state to the alarming state when the vibration detection section detects a vibration. The alarm section issues an alarm when the state retention section is in the alarming state. The operation control section forcedly controls the transition of the state retention section, based on an operation by an operator.

The display device is provided with the anti-theft section for preventing the display device from theft. When the anti-theft section senses at least a fixed level of shake of the display device by means of the vibration sensor, the alarm section issues the alarm. Therefore, the display device is effectively prevented from theft.

Additionally, the operation control section forcedly controls the transition of the state retention section, based on the operation by the operator through the operation control section. The use of this capability prevents an alarm from being issued from the alarm section due to the vibration generated by the normal movement of the display device, thereby improving the convenience and operability of the display device with anti-theft capability.

While no power is supplied to the image display section, the second power supply section continues supplying power to the anti-theft section to take caution against the theft of the display device.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

Figure 1:
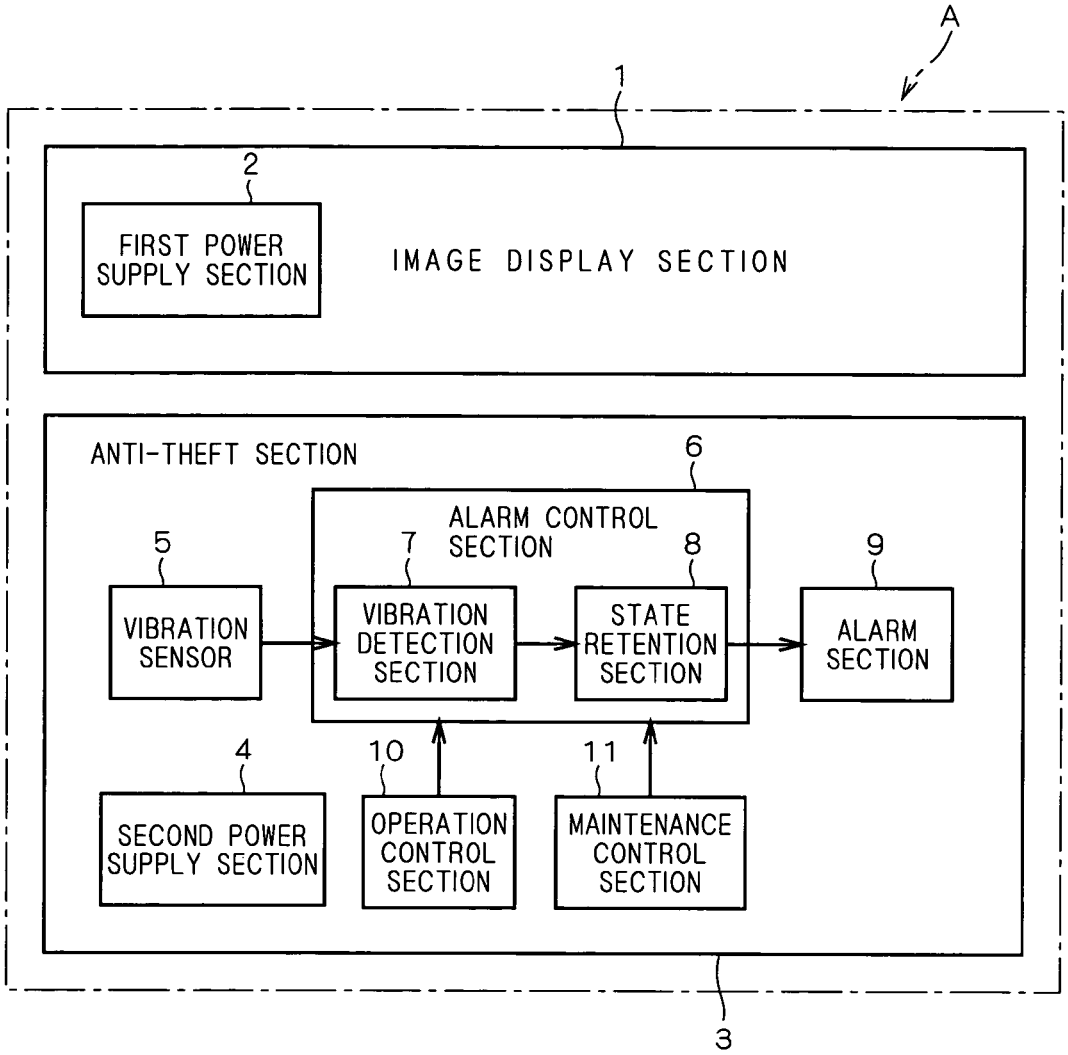
FIG. 1 is a block diagram showing the construction of the body of a display device according to a first preferred embodiment of the present invention.

FIG. 1 is a schematic block diagram showing the construction of a display device according to a first preferred embodiment of the present invention. The display device shown in FIG. 1 comprises an image display section 1 for displaying images, a first power supply section 2 for supplying power to the image display section 1, an anti-theft section 3 for preventing a display device body A from theft, and a second power supply section 4 for supplying power to the anti-theft section 3 independently of the first power supply section 2, the sections 1 to 4 being provided within an enclosure of the display device body A. The display device body A, as that term is used herein, is a substantial component of the display device excepting accessory components such as a base for supporting the display device body A. The above-mentioned sections 1 to 4 are integrally incorporated in the single enclosure of the display device body A.

The image display section 1 is a section having all of the functions of the body of a typical display device. The image display section 1 is supplied with power from the first power supply section 2 to effect an image signal processing and various types of control relating to display, to directly display the description of an image signal on a display element (not shown) and to project images.

The anti-theft section 3 includes a vibration sensor 5, an alarm control section 6, an alarm section 9, an operation control section 10, and a maintenance control section 11. The vibration sensor 5 senses a shake of the display device body A to output a sensor signal. The sensor signal outputted from the vibration sensor 5 is inputted to the alarm control section 6. The alarm control section 6 includes a vibration detection section 7 and a state retention section 8. The vibration detection section 7 detects the sensor signal from the vibration sensor 5 to provide a detection signal to the state retention section 8. The state retention section 8 retains two states: a cautionary state in which caution is taken against the theft of the display device; and an alarming state indicating that the display device is being stolen. The state retention section 8 provides a state signal to the alarm section 9. The operation control section 10 is an element for effecting control, based on the operation by an operator, and provides an operation control signal to the alarm control section 6. The maintenance control section 11 is an element for effecting control, based on the action of maintenance by a maintainer, and provides a maintenance control signal to the alarm control section 6.

Figure 2:
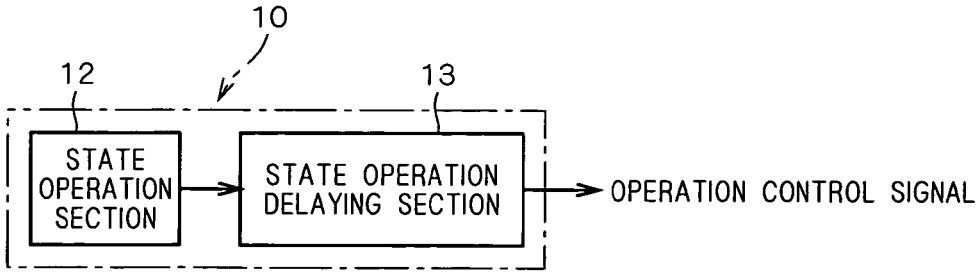
FIG. 2 is a block diagram showing the construction of an operation control section in the display device body.

FIG. 2 is a block diagram showing the internal construction of the operation control section 10. The operation control section 10 includes a state operation section 12 for accepting a state operation (the operation of changing the state) by the operator, and the state operation delaying section 13. The operation control signal corresponding to information about (or a result of) the operation accepted by the state operation section 12 is delayed by a fixed time interval in the state operation delaying section 13, and is then provided to the alarm control section 6.

Figure 3:
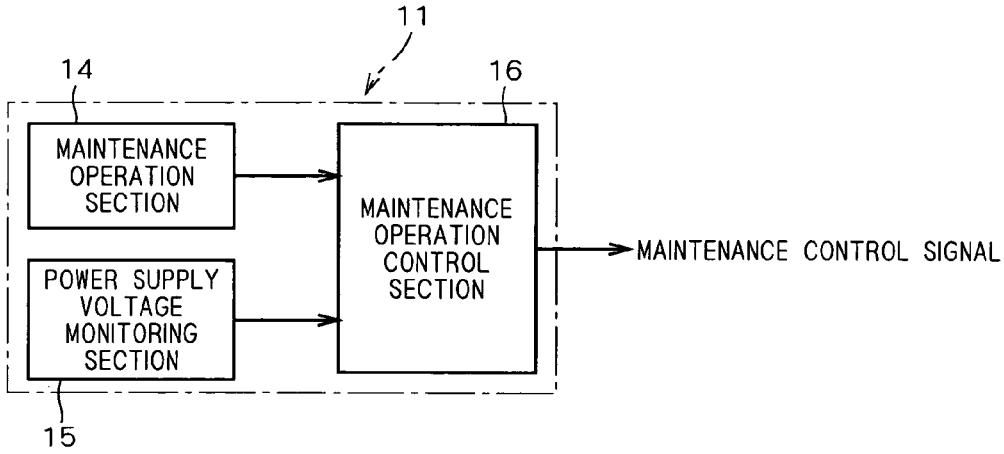
FIG. 3 is a block diagram showing the construction of a maintenance control section in the display device body.

FIG. 3 is a block diagram showing the internal construction of the maintenance control section 11. The maintenance control section 11 includes a maintenance operation section 14 for accepting an operation for maintenance (maintenance operation) by the maintainer, a power supply voltage monitoring section 15, and a maintenance operation control section 16. The power supply voltage monitoring section 15 monitors a power supply voltage supplied from the second power supply section 4. Maintenance operation information in the maintenance operation section 14 and monitoring information from the power supply voltage monitoring section 15 are provided to the maintenance operation control section 16. The maintenance control signal from the maintenance operation control section 16 is provided to the alarm control section 6.

Next, the operation of the display device will be briefly described. The second power supply section 4 supplies power to the anti-theft section 3 independently of the operation of the first power supply section 2 supplying power to the image display section 1. This provides continuous power supply to the anti-theft section 3 to allow caution against theft of the display device even while no power is supplied to the image display section 1.

In the anti-theft section 3, the vibration sensor 5 senses a vibration caused by a shake of the display device body A to provide the sensor signal responsive to the vibration to the vibration detection section 7 in the alarm control section 6. The vibration detection section 7 judges that the vibration is an abnormal vibration resulting from theft when the level of the sensor signal from the vibration sensor 5 is greater than a predetermined reference level. The anti-theft section 3 can selectively enter one of the two states: the cautionary state and the alarming state. The state retention section 8 retains these states. A transition from the cautionary state to the alarming state takes place in response to the detection signal from the vibration detection section 7. The alarm section 9 issues an alarm by an alarming technique such as emitting a sound, light or the like when the state signal from the state retention section 8 indicates the alarming state.

Figure 4:
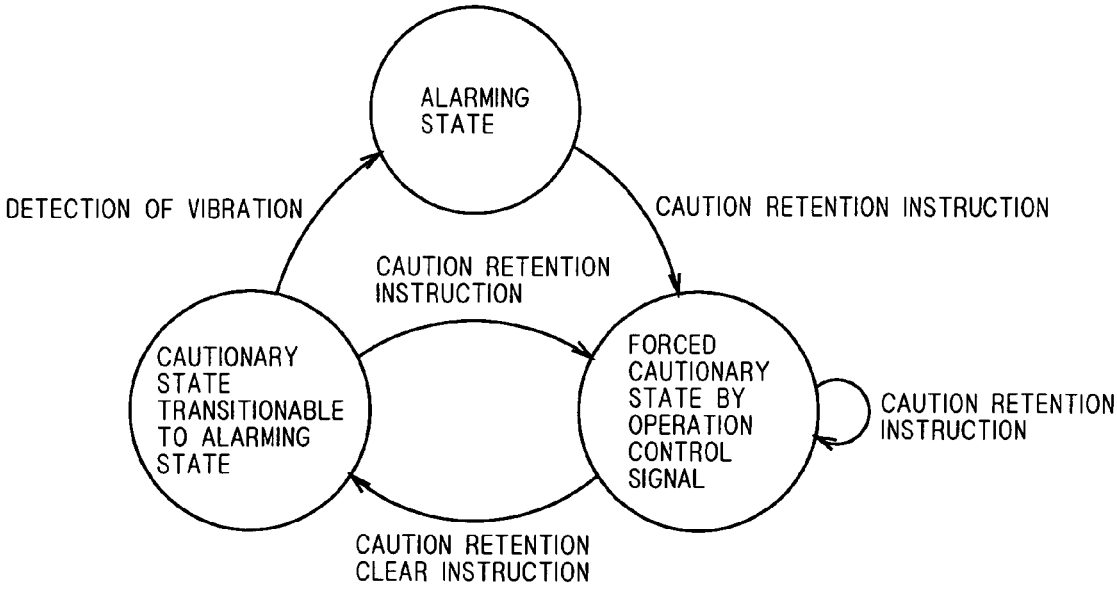
FIG. 4 illustrates state transitions of a state retention section in the display device body.

The operation control section 10 serves as an interface for the state operation of the anti-theft section 3 by the operator. When moving the display device for the purpose of other than theft, it is necessary to retain the cautionary state without transition from the cautionary state to the alarming state independently of the sensor signal from the vibration sensor 5. In such a case, a caution retention instruction in the form of the operation control signal from the operation control section 10 causes the cautionary state to be forcedly retained. Once a transition is made to the alarming state, the state retention section 8 continues retaining the alarming state. It is hence necessary for the operator to clear the alarming state. To clear the alarming state, the caution retention instruction in the form of the operation control signal from the operation control section 10 causes the state retention section 8 to forcedly make a transition from the alarming state to the cautionary state and to retain the cautionary state. To take caution against theft again in the above-mentioned two cases, a caution retention clear instruction in the form of the operation control signal is used to clear the retention of the forced cautionary state. The above-mentioned transitions between the states are shown in FIG. 4.

The operation of the operation control section 10 will be described with reference to FIG. 2. When the operator operates the state operation section 12, the result of operation is delayed by the state operation delaying section 13, and thereafter the caution retention instruction or the caution retention clear instruction is provided as the operation control signal to the state retention section 8. Thus, after a fixed time interval has elapsed since the operation of the state operation section 12 by the operator, the state transition is made in the state retention section 8. This is effective in preventing the occurrence of a transition from the cautionary state to the alarming state due to the vibration resulting from the state operation by the operator. Such an operation of the operation control section 10 further improves operability.

The state operation section 12 of the operation control section 10 and the maintenance operation section 14 of the maintenance control section 11 to be described below are provided in a location difficult for a thief to find, such as the side or back surface of the display device body A.

The maintenance control section 11 serves as an interface for the maintenance operation of the anti-theft section 3 by the maintainer. The maintainer operates the maintenance control section 11 to cause the maintenance control signal from the maintenance control section 11 to temporarily place the state retention section 8 into the alarming state, thereby causing the alarm section 9 to issue an alarm. Thus, the maintainer can check whether or not the alarm control section 6 and the alarm section 9 normally perform an alarm issuing operation. The maintenance control signal from the maintenance control section 11 may be of the type wherein a dummy sensor signal is provided to the vibration detection section 7.

When the second power supply section 4 includes an unrechargeable primary battery, it is necessary to check battery power for battery replacement. Because of the anti-theft purpose, however, the display device body A must be structured to make it difficult to remove the battery. The maintenance control section 11 according to the first preferred embodiment enables the maintainer to check the battery power without the need to remove the battery from the display device body A. Specifically, the maintenance operation control section 16 judges that the battery power remains when the power supply voltage is greater than a predetermined reference voltage level during the maintenance operation, based on the maintenance operation information from the maintenance operation section 14 and the monitoring information from the power supply voltage monitoring section 15. Then, the maintenance operation control section 16 provides the maintenance control signal to the alarm control section 6 to temporarily place the state retention section 8 into the alarming state, thereby causing the alarm section 9 to inform the maintainer that the battery power remains. This enables the maintainer to perform the action of maintenance for checking whether or not the alarm control section 6 and the alarm section 9 normally perform an alarm operation, as well as to check the battery power at the same time.

Figure 5:
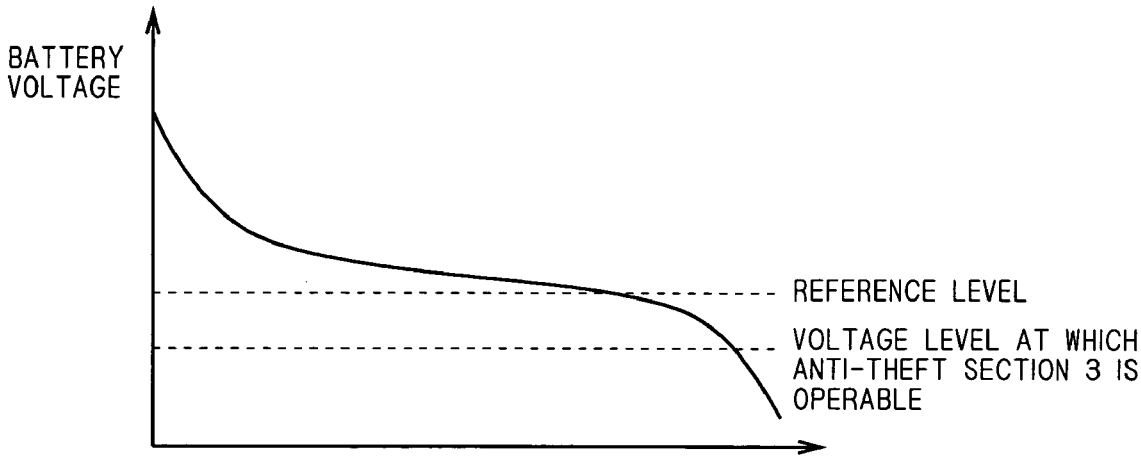
FIG. 5 is a graph showing a relationship between a reference level of a power supply voltage monitoring section and a power supply voltage in the display device body.

The above-mentioned judgment about the battery power uses such a characteristic of the battery that the battery voltage decreases as the battery power decreases. The reference voltage level for comparison in the power supply voltage monitoring section 15 according to the first preferred embodiment is set at not less than the voltage at which the anti-theft section 3 is operable, as shown in FIG. 5. This prevents a situation in which the battery voltage decreases to stop the operation of the anti-theft section 3 immediately after the check of the battery power.

Figure 6:
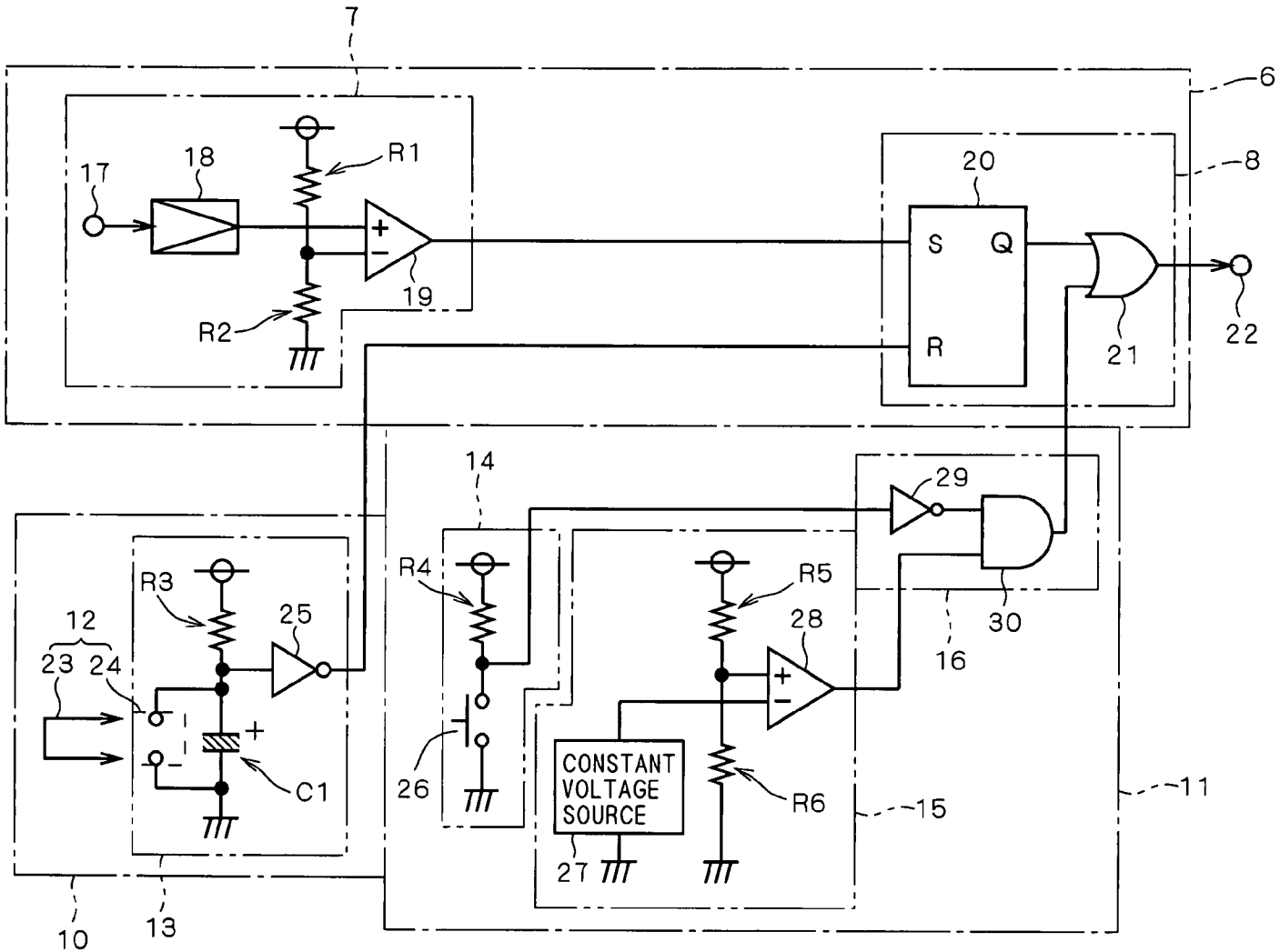
FIG. 6 is a circuit diagram showing a specific circuit example of an alarm control section, the operation control section and the maintenance control section in the display device body.

FIG. 6 shows an example of specific circuitry constituting the above-mentioned anti-theft section 3. Referring to FIG. 6, the vibration detection section 7 in the alarm control section 6 includes an amplifier 18, a comparator 19, and resistors R1 and R2. The state retention section 8 includes an RS flip-flop 20 and a logic element (OR element) 21. The state operation section 12 in the operation control section 10 includes a terminal 24, and a conducting pin 23 for connection to the terminal 24. The state operation delaying section 13 includes a resistor R3, a capacitor C1 and an inverter 25. The maintenance operation section 14 in the maintenance control section 11 includes a resistor R4 and a push switch 26. The power supply voltage monitoring section 15 includes a constant voltage source 27, a comparator 28, and resistors R5 and R6. The maintenance operation control section 16 includes an inverter 29, and a logic element (AND element) 30.

The circuit operation of FIG. 6 will be described. The sensor signal from the vibration sensor 5 (FIG. 1) is provided to a terminal 17 of the vibration detection section 7 in the alarm control section 6, and is amplified by the amplifier 18. The amplified sensor signal is provided to the positive terminal of the comparator 19. A predetermined reference voltage for comparison established by the resistors R1 and R2 is applied to the negative terminal of the comparator 19. The comparator 19 compares the signal level at the positive terminal with the reference voltage level at the negative terminal. When the signal level at the positive terminal is higher than the reference voltage level at the negative terminal as a result of comparison, the comparator 19 outputs a binary electric signal at a logic high level (abbreviated hereinafter as "H") as the detection signal. When the signal level at the positive terminal is lower than the reference voltage level at the negative terminal, the comparator 19 outputs the binary electric signal at a logic low level (abbreviated hereinafter as "L"). When "H" is inputted from the comparator 19 to an input terminal S of the RS flip-flop 20, the output terminal Q of the RS flip-flop 20 makes an "L" to "H" transition and holds the "H" output. On the other hand, when "H" is inputted to an input terminal R of the RS flip-flop 20, the output terminal Q of the RS flip-flop 20 makes an "H" to "L" transition and holds the "L" output. Although the input terminals S and R are inhibited from becoming "H" at the same time in typical RS flip-flops, it is assumed in the RS flip-flop 20 in the first preferred embodiment that the operation at the input terminal R has higher priority if both of the input terminals S and R are "H" at the same time.

The conducting pin 23 of the state operation section 12 in the operation control section 10 provides electrical contact between the electrodes of the terminal 24 when the conducting pin 23 is inserted in the terminal 24. The operator controls the state of the state retention section 8 by inserting and withdrawing the conducting pin 23 into and from the terminal 24. When the operator inserts the conducting pin 23 in the terminal 24, the inverter 25 receives "L" at its input to provide "H" to the input terminal R of the RS flip-flop 20. Then, the output terminal Q of the RS flip-flop 20 is forcedly held low (in the forced cautionary state). On the other hand, when the operator withdraws the conducting pin 23 from the terminal 24, the inverter 25 receives "H" to provide "L" to the input terminal R of the RS flip-flop 20. Then, the output terminal Q of the RS flip-flop 20 is placed into an "L" to "H" transitionable state (or the cautionary state transitionable to the alarming state). The "H" to "L" transition at the input terminal R of the RS flip-flop 20 takes place after a delay of the fixed time interval caused by a charging circuit having the resistor R3 and the capacitor C1 in the state operation delaying section 13. This is effective in holding "H" at the input terminal R of the RS flip-flop 20 and holding the "L" output at the output terminal Q even if the operator withdraws the conducting pin 23 to generate a shake of the display device body A whereby the detection signal is provided to the input terminal S of the RS flip-flop 20.

The comparator 28 of the power supply voltage monitoring section 15 in the maintenance control section 11 makes a comparison between a first voltage level which is the power supply voltage from the battery divided by the resistors R5 and R6 and a second voltage level from the constant voltage source 27 independent of the power supply voltage to monitor the power supply voltage. When sufficient battery power remains and the first voltage level is higher than the second voltage level from the constant voltage source 27, the comparator 28 outputs "H." When the battery power decreases and the first voltage level is less than the second voltage level from the constant voltage source 27, the comparator 28 outputs "L." When the push switch 26 of the maintenance operation section 14 in the maintenance control section 11 is not pushed, the inverter 29 outputs "L" to cause the logic element (AND element) 30 to output "L" independently of the output from the comparator 28. When the maintainer pushes the push switch 26 for the action of maintenance for checking the battery power, the inverter 29 outputs "H." The logic element (AND element) 30 provides the result of comparison in the comparator 28 to the logic element (OR element) 21 of the state retention section 8 in the alarm control section 6 while the maintainer pushes the push switch 26.

The logic element (OR element) 21 outputs "H" indicating the alarming state through a terminal 22 to the alarm section 9 to cause the alarm section 9 to issue an alarm when the output terminal Q of the RS flip-flop 20 is "H" in response to the detection signal for vibration or when the maintainer pushes the push switch 26 to cause the logic element (AND element) 30 to temporarily output "H." Thus, the alarm control section 6 serves in cooperation with the operation control section 10 and the maintenance control section 11 to effect state control and maintenance control.

Figure 7:
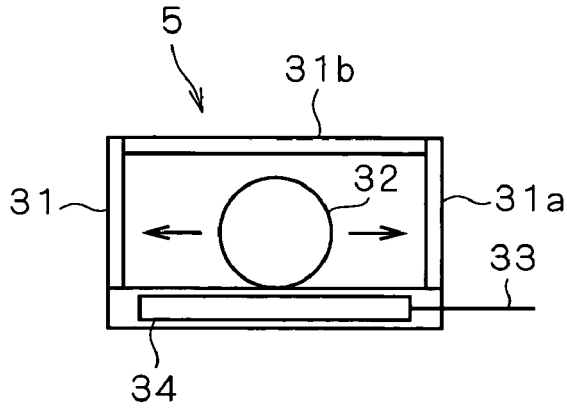
FIG. 7 is a sectional view showing the construction of a vibration sensor in the display device body.
Figure 8:
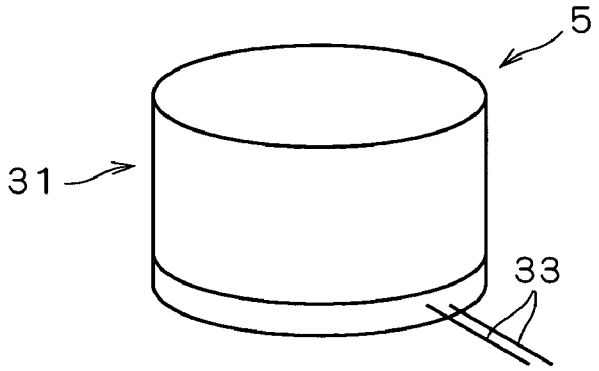
FIG. 8 is an external perspective view of the vibration sensor of FIG. 7.

FIGS. 7 and 8 are a sectional view and an external perspective view, respectively, of the vibration sensor 5. The vibration sensor 5 includes a case 31 of cylindrical shape, a sphere 32 movably received in the case 31, an impact transfer wall 31*a* defining the peripheral wall of the case 31 and for transferring the impact of the sphere 32, and a piezoelectric element 34 in a bottom portion of the case 31 for converting the impact of the sphere 32 transferred through the impact transfer wall 31*a* into an electric signal to output the electric signal through leads 33. An upper wall portion of the case 31 is defined by a cover 31*b*.

The sphere 32 in the vibration sensor 5 moves on the bottom surface in the case 31 as the display device body A shakes. In particular, when the bottom surface is inclined with respect to the horizontal, the sphere 32 moves to collide against the impact transfer wall 31*a* corresponding to the side surface of the case 31. The impact transfer wall 31*a* transfers the impact due to the sphere movement to the piezoelectric element 34 in the bottom portion. The piezoelectric element 34 converts the impact into the electric signal according to the impact to output the electric signal through the leads 33.

Such a construction of the vibration sensor 5 can sense the movement of the sphere 32 as the shake of the display device body A. The cylindrical shape of the case 31 receiving the sphere 32 imposes no limitations on the direction of movement of the sphere 32 to achieve the sensing of the shake in all directions.

As described hereinabove, the display device according to the first preferred embodiment includes the anti-theft section 3 for preventing the display device from theft. When the anti-theft section 3 senses at least a fixed level of shake of the display device by means of the vibration sensor 5, the alarm section 9 issues an alarm. This effectively prevents the theft of the display device.

The state retention section 8 may be forcedly held in the cautionary state, based on the state operation using the conducting pin 23 (insertion of the conducting pin 23) by the operator. The use of this capability prevents an alarm from being issued from the alarm section 9 due to the vibration generated by the normal movement of the display device, thereby improving the convenience and operability of the display device with anti-theft capability.

While no power is supplied to the image display section 1, the second power supply section 4 continues supplying power to the anti-theft section 3 to take caution against the theft of the display device.

The anti-theft section 3 is incorporated in the display device to protect the display device from theft, and the state operation section 12 of the operation control section 10 and the maintenance operation section 14 of the maintenance control section 11 are provided in a location difficult for a thief to find, such as the side or back surface of the display device. This improves the anti-theft performance while maintaining the operability of these operation sections.

The information about the operation performed on the state operation section 12 is reflected in the state retention section 8 after the delay of the fixed time interval created by the state operation delaying section 13. This is effective in preventing the occurrence of the transition from the cautionary state to the alarming state due to the vibration resulting from the state operation (the withdrawal of the conduction pin 23) by the operator, to further improve the operability.

The maintainer may perform a predetermined operation on the maintenance operation section 14 to check whether or not the anti-theft section 3 normally performs the alarm issuing operation. Therefore, the display device also has good maintainability.

If the second power supply section 4 includes a battery, the maintainer may perform a predetermined operation on the maintenance operation section 14 provided in the anti-theft section 3 to cause the maintenance operation control section 16 to check the battery power of the second power supply section 4 by means of the power supply voltage monitoring section 15. It is, therefore, easy to check the battery power.

When the maintenance operation control section 16 judges that the battery power of the second power supply section 4 remains as a result of the check of the battery power, the maintenance operation control section 16 causes the alarm section 9 to temporarily issue an alarm. Thus, the maintainer performs the operation for maintenance to check the battery power and to check whether or not the anti-theft section 3 normally performs the alarm operation at the same time.

The vibration sensor 5 is constructed so that the sphere 32 movably received in the cylindrical case 31 moves due to the shake of the display device to collide against the peripheral wall of the case 31, and the piezoelectric element 34 senses the impact during the collision, thereby to sense the shake of the display device. Such a simple construction can precisely sense the shake of the display device.

The cylindrical shape of the case 31 receiving the sphere 32 in the vibration sensor 5 imposes no limitations on the direction of movement of the sphere 32 to achieve the sensing of the shake of the display device in all directions.

Second Preferred Embodiment

Figure 9:
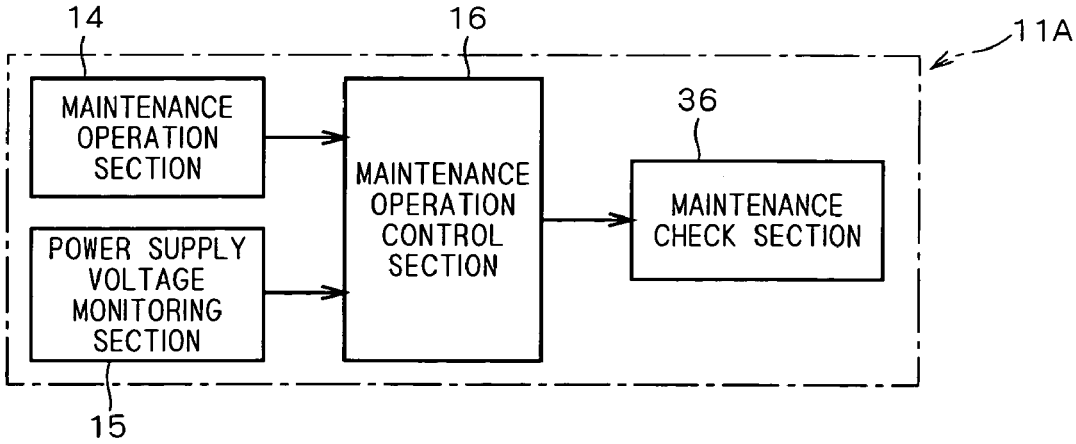
FIG. 9 is a block diagram showing the construction of the maintenance control section in the display device according to a second preferred embodiment of the present invention.

FIG. 9 is a block diagram showing a partial construction of the display device according to a second preferred embodiment of the present invention. The second preferred embodiment employs a maintenance control section 11A having the construction shown in FIG. 9 in place of the maintenance control section 11 in the display device of the first preferred embodiment. Parts of the display device according to the second preferred embodiment corresponding to those of the display device according to the first preferred embodiment are designated by identical reference numerals and characters, and will not be described.

The maintenance control section 11A includes a maintenance check section 36 in addition to the maintenance operation section 14, the power supply voltage monitoring section 15 and the maintenance operation control section 16 which are the constituents of the maintenance control section 11 of the first preferred embodiment. In the first preferred embodiment, the alarm section 9 for issuing an alarm when a shake of the display device body A is sensed also serves as the element for checking the maintenance operation such as checking the battery power. The second preferred embodiment, on the other hand, employs the maintenance check section 36 specifically designed to check the maintenance operation. With reference to FIG. 9, the maintenance operation information in the maintenance operation section 14 and the power supply voltage monitoring information from the power supply voltage monitoring section 15 are provided to the maintenance operation control section 16, and the maintenance control signal from the maintenance operation control section 16 is provided to the maintenance check section 36.

Figure 10:
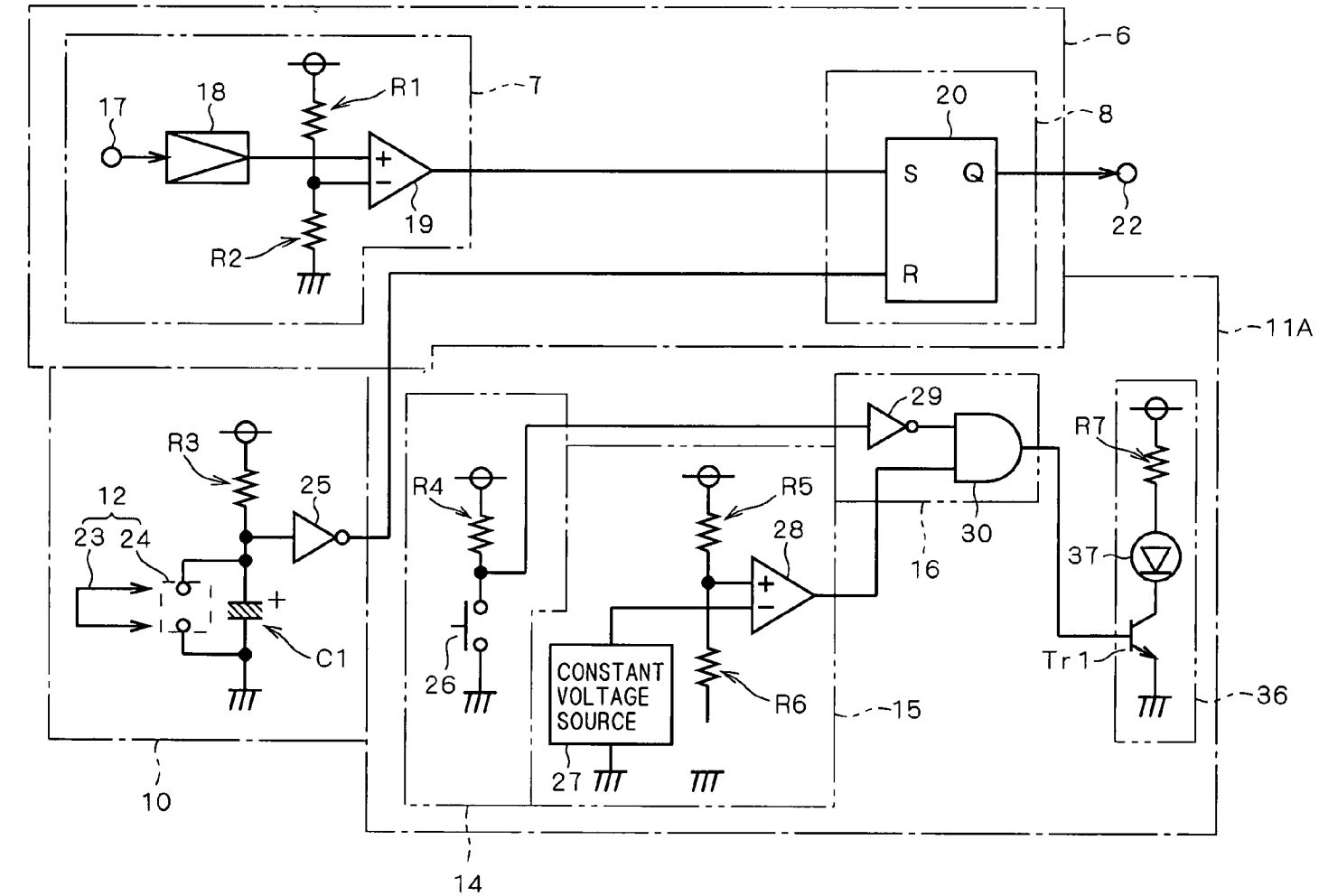
FIG. 10 is a circuit diagram showing a specific circuit example of the alarm control section, the operation control section and the maintenance control section in the display device body.

FIG. 10 shows an example of the specific circuit configuration of the alarm control section 6, the operation control section 10 and the maintenance control section 11A in the display device according to the second preferred embodiment. Referring to FIG. 10, the output from the output terminal Q of the RS flip-flop 20 constituting the state retention section 8 of the alarm control section 6 is provided through the terminal 22 to the alarm section 9. The maintenance check section 36 includes a resistor R7, a light-emitting diode 37, and a transistor Tr1. Thus, if the output from the logic element (AND element) 30 becomes "H" as a result of comparison between the power supply voltage responsive to the battery power and the reference voltage from the constant voltage source 27 when the push switch 26 in the maintenance control section 11A is pushed for maintenance operation, the transistor Tr1 in the maintenance check section 36 turns on to drive the light-emitting diode 37. The light emission from the light-emitting diode 37 allows the maintainer to check the operation of the anti-theft section 3 and the battery power. Other structures and their operations are substantially similar to those of the first preferred embodiment shown in FIG. 6, and will not be described.

The display device according to the second preferred embodiment produces effects substantially similar to those of the first preferred embodiment except the provision of the maintenance check section 36 and its associated parts. The display device according to the second preferred embodiment produces an additional peculiar effect to be described below.

The maintainer causes the light-emitting diode 37 to emit light, thereby checking the action of maintenance. The check by the maintenance operation in this case does not require the alarm which uses as high a sound or light level as that of the alarm section 9, to suppress the power consumption required by the maintenance operation.

The maintenance check section 36 shown in FIG. 10 uses light emission from the light-emitting diode 37, but may use a sounding section such as a buzzer.

Third Preferred Embodiment

Figure 11:
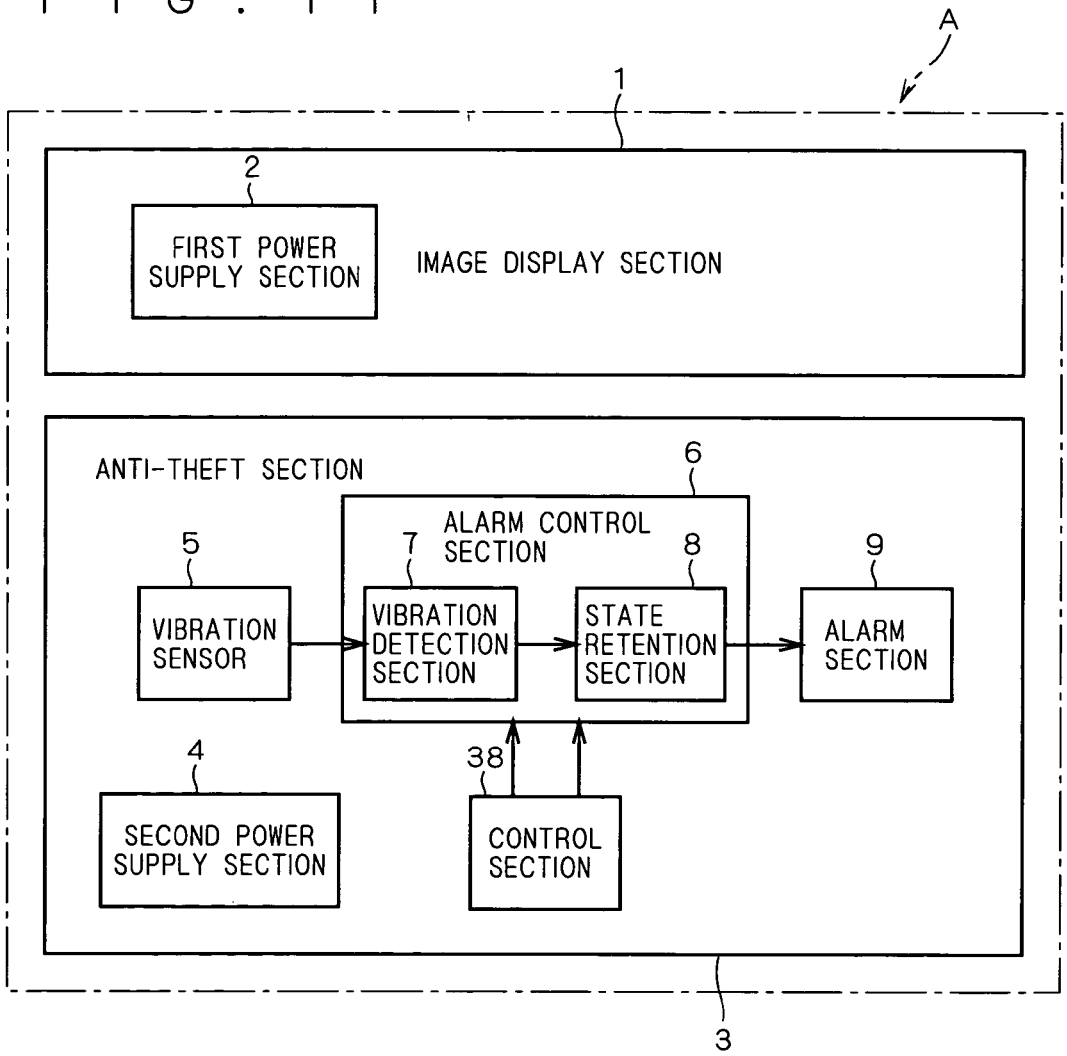
FIG. 11 is a block diagram showing the construction of the body of the display device according to a third preferred embodiment of the present invention.

FIG. 11 is a schematic block diagram showing the construction of the display device according to a third preferred embodiment of the present invention. In the third preferred embodiment, the operation control section 10 and the maintenance control section 11 of the anti-theft section 3 in the display device of the first preferred embodiment are integrated together into a control section 38 for effecting the operation control and the maintenance control at the same time. Other structures of the third preferred embodiment are identical with those of the first preferred embodiment. Parts of the third preferred embodiment corresponding to those of the first preferred embodiment are designated by the same reference numerals and characters, and will not be described.

Figure 12:
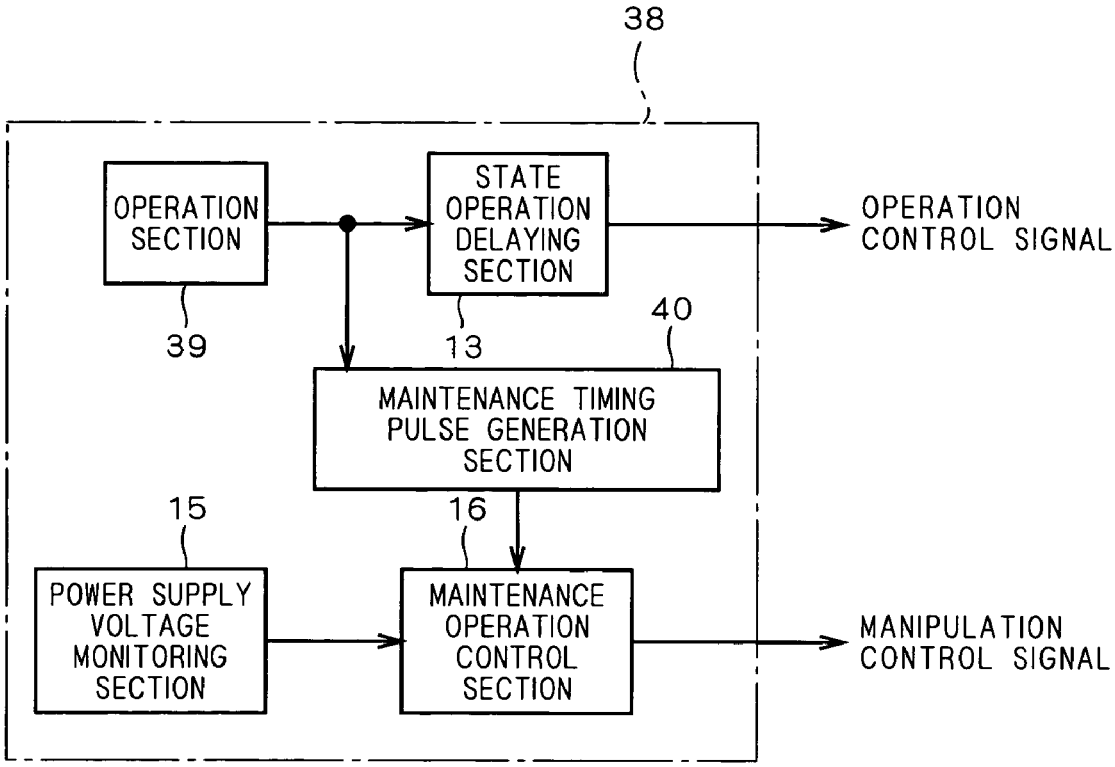
FIG. 12 is a block diagram showing the construction of a control section in the display device body.

FIG. 12 is a schematic block diagram showing the construction of the control section 38. Referring to FIG. 12, a result of operation in an operation section 39 is provided to the state operation delaying section 13 and a maintenance timing pulse generation section 40. A timing pulse from the maintenance timing pulse generation section 40 and the monitoring information from the power supply voltage monitoring section 15 are provided to the maintenance operation control section 16. The operation control signal from the state operation delaying section 13 and the maintenance control signal from the maintenance operation control section 16 are provided to the alarm control section 6.

Specific operation of the control section 38 will be described. When a predetermined operation is performed on the operation section 39, the result of the operation (or the information about the operation) is accepted by the operation section 39, and is delayed by the state operation delaying section 13. The delayed result is then provided as the operation control signal to the alarm control section 6, and is also provided to the maintenance timing pulse generation section 40. In response to the acceptance of the predetermined operation by the operation section 39, the maintenance timing pulse generation section 40 extracts a change in the result of the operation to generate the maintenance timing pulse having a predetermined pulse duration. During a time interval between the generation of the maintenance timing pulse and the end of the pulse duration, the maintenance operation control section 16 checks the monitoring information from the power supply voltage monitoring section 15, and provides the maintenance control signal to the alarm control section 6 when the battery power remains. In accordance with the maintenance control signal, the alarm control section 6 causes the alarm section 9 to temporarily issue an alarm. The temporary alarm allows the operator to check the maintenance operation. In this manner, the use of the operation section 39 allows the operator to perform the state control operation, the check of the battery power, and the action of maintenance for checking whether or not the alarm section 9 operates normally at the same time.

Figure 13:
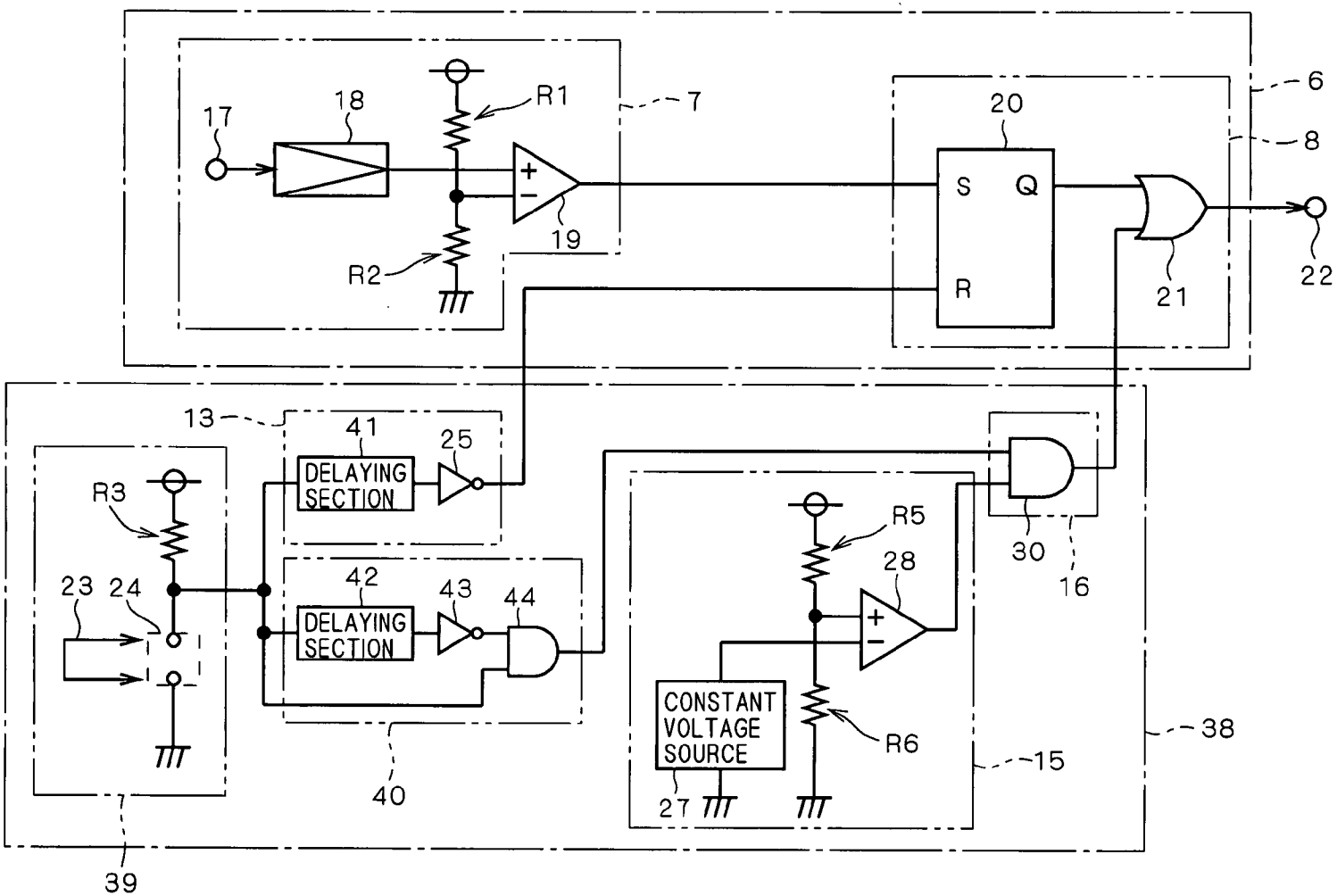
FIG. 13 is a circuit diagram showing a specific circuit example of the alarm control section and the control section in the display device body.

FIG. 13 shows an example of the specific circuit configuration of the alarm control section 6 and control section 38 according to the third preferred embodiment. Referring to FIG. 13, the vibration detection section 7 in the alarm control section 6 includes the amplifier 18, the comparator 19, and the resistors R1 and R2. The state retention section 8 includes the RS flip-flop 20 and the logic element (OR element) 21. The operation section 39 in the control section 38 includes the resistor R3, the terminal 24, and the conducting pin 23 for connection to the terminal 24. The state operation delaying section 13 includes a delaying section 41 and the inverter 25. The maintenance timing pulse generation section 40 includes a delaying section 42, an inverter 43, and a logic element (AND element) 44. The power supply voltage monitoring section 15 includes the constant voltage source 27, the comparator 28, and the resistors R5 and R6.

The maintenance operation control section 16 includes the logic element (AND element) 30.

The circuit operation of FIG. 13 will be described. As in the circuit example (FIG. 6) of the first preferred embodiment, the sensor signal from the vibration sensor 5 is provided to the terminal 17 of the vibration detection section 7 in the alarm control section 6, and is amplified by the amplifier 18. The amplified sensor signal is provided to the comparator 19. The comparator 19 compares the amplified sensor signal level with the reference voltage level previously established by the resistors R1 and R2. The result of comparison is provided as the detection signal to the input terminal S of the RS flip-flop 20.

The conducting pin 23 provides electrical contact between the electrodes of the terminal 24 when the conducting pin 23 is inserted in the terminal 24. When the conducting pin 23 is inserted in the terminal 24, the inverter 25 constituting the state operation delaying section 13 receives "L" at its input to provide "H" to the input terminal R of the RS flip-flop 20 constituting the state retention section 8. Then, the output terminal Q of the RS flip-flop 20 is forcedly held low. On the other hand, when the operator withdraws the conducting pin 23 from the terminal 24, the output from the operation section 39 changes from "L" to "H." The change is delayed by the delaying section 41 in the state operation delaying section 13, and is then provided to the inverter 25. Thus, "L" is inputted to the input terminal R of the RS flip-flop 20. Then, the output terminal Q of the RS flip-flop 20 is placed into the "L" to "H" transitionable state. Therefore, "H" is held at the input terminal R of the RS flip-flop 20 and "L" is held at the output terminal Q even if the operator withdraws the conducting pin 23 to generate a shake of the display device body A whereby the detection signal is provided to the input terminal S of the RS flip-flop 20. In other words, the shake of the display device body A due to the action of maintenance is prevented from being misidentified as that resulting from theft.

Figure 14:
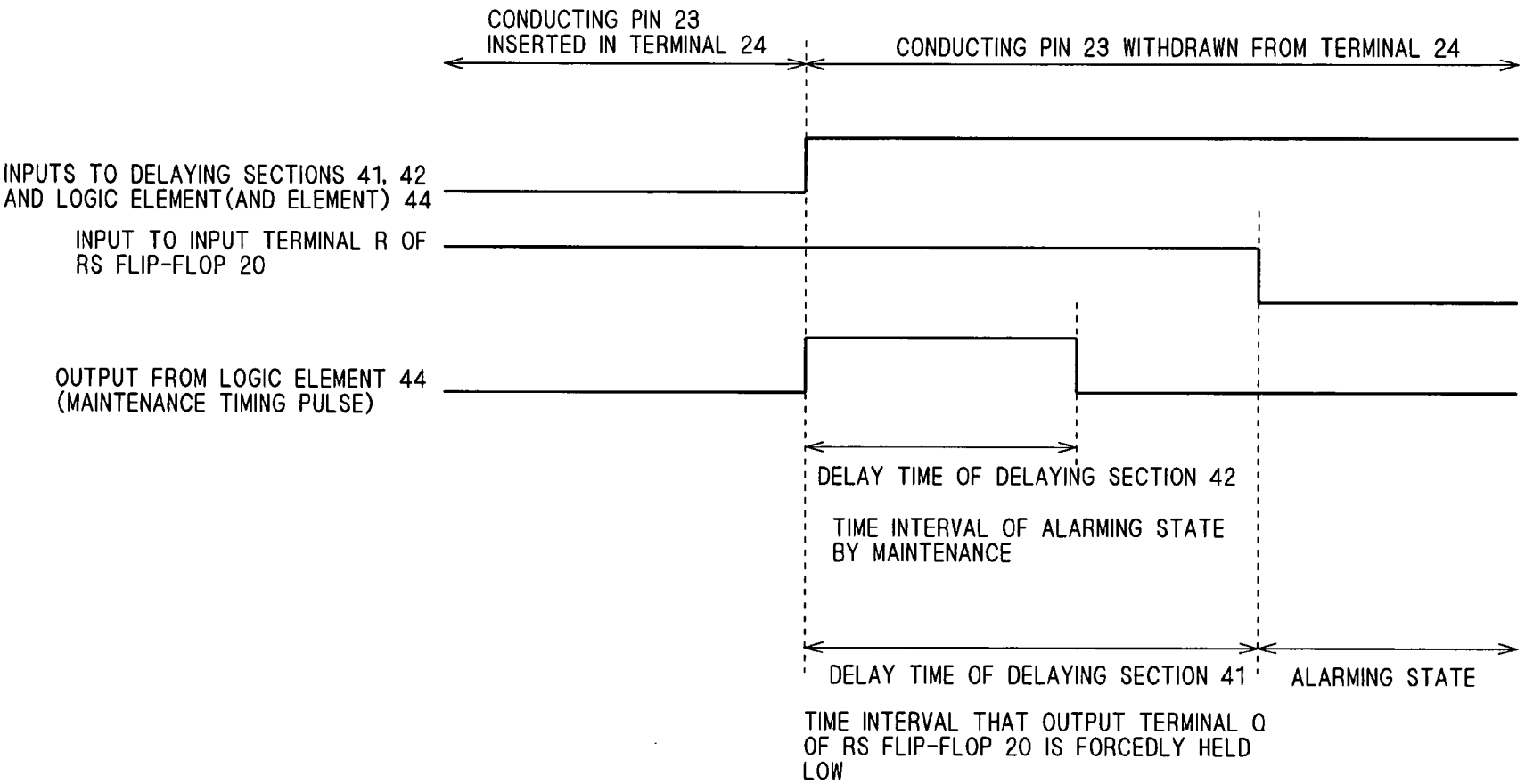
FIG. 14 is a timing chart of the insertion and withdrawal of a conducting pin in the display device body.

In the maintenance timing pulse generation section 40 including the delaying section 42, the inverter 43 and the logic element (AND element) 44, when the conducting pin 23 is inserted in the terminal 24 (or in the case of no maintenance), "L" is provided to the delaying section 42 and the logic element (AND element) 44. The logic element (AND element) 44 then outputs "L" which in turn is provided to the logic element (AND element) 30 constituting he maintenance operation control section 16. On the other hand, when the operator withdraws the conducting pin 23 from the terminal 24 (to perform maintenance), "H" is provided to the delaying section 42 and the logic element (AND element) 44. The output from the logic element (AND element) 44 is held "H" only during the delay time interval created by the delaying section 42. This "H" output is provided as the maintenance timing pulse to the logic element (AND element) 30 constituting he maintenance operation control section 16. At this time, if the battery power remains sufficiently and "H" is outputted from the comparator 28 (which will be described in detail later), the maintenance timing pulse is provided through the logic element (OR element) 21 of the alarm control section 6 to the alarm section 9. The alarm section 9 issues an alarm as a dummy alarm given by the action of maintenance for the length of time for which the maintenance timing pulse is outputted. FIG. 14 is a timing chart showing the input to the input terminal R of the RS flip-flop 20 and the output (the maintenance timing pulse) from the logic element (AND element) 44 when a transition takes place from the insertion of the conducting pin 23 in the terminal 24 to the withdrawal of the conducting pin 23 from the terminal 24.

As in the first preferred embodiment, the comparator 28 constituting the power supply voltage monitoring section 15 makes the comparison between the first voltage level which is the power supply voltage from the battery divided by the resistors R5 and R6 and the second voltage level from the constant voltage source 27 to monitor the power supply voltage. The logic element (AND element) 30 constituting the maintenance operation control section 16 provides the result of comparison of the comparator 28 to the logic element (OR element) 21 of the alarm control section 6 during the period that the maintenance timing pulse is outputted. Thus, the logic element (OR element) 21 provides "H" indicating the alarming state through the terminal 22 to the alarm section 9 to cause the alarm section 9 to issue an alarm when the output terminal Q of the RS flip-flop 20 is "H" in response to the detection signal for vibration in the case of no maintenance and when the logic element (AND element) 30 outputs "H."

While the logic element (AND element) 30 outputs "H," the power supply voltage monitoring section 15 judges that the battery power remains, and the maintenance timing pulse is being outputted. Thus, when the battery power remains, the alarm section 9 issues an alarm in response to the withdrawal of the conducting pin 23 in the operation section 39, based on the period that the maintenance timing pulse is outputted.

As described hereinabove, the display device according to the third preferred embodiment produces effects substantially similar to those of the first preferred embodiment except the provision of the control section 38 and its associated parts. Additionally, the display device according to the third preferred embodiment allows the operator who operates the operation section 39 to perform the state control operation, the check of the battery power, and the action of maintenance for checking whether or not the alarm section 9 operates normally at the same time, thereby further improving the operability and maintainability.

While the invention has been described in detail, the foregoing description is in all aspects illustrative and not restrictive. It is understood that numerous other modifications and variations can be devised without departing from the scope of the invention.

What is claimed is:

1. A display device comprising:

an image display section for presenting a display based on an image signal;

a first power supply section for supplying power to said image display section;

an anti-theft section for preventing said display device from theft; and a second power supply section provided independently of said first power supply section for supplying power to said anti-theft section, said anti-theft section including a vibration sensor for sensing a shake of said display device, a vibration detection section for making a comparison between an output level from said vibration sensor and a previously determined reference level to detect the presence or absence of a vibration, a state retention section for selectively retaining a cautionary state in which caution is taken against theft of said display device and an alarming state indicating that said display device is being stolen, said state retention section making a transition from said cautionary state to said alarming state when said vibration detection section detects a vibration, an alarm section for issuing an alarm when said state retention section is in said alarming state, and an operation control section for forcedly controlling the transition of said state retention section, based on an operation by an operator.

2. The display device according to claim 1, wherein said operation control section includes a state operation section for use by the operator in forcedly operating the transition of said state retention section, and a state operation delaying section for delaying information about the operation accepted by said state operation section by a fixed time interval to reflect the information about the operation in said state retention section.

3. The display device according to claim 1, wherein said anti-theft section further includes a maintenance control section for effecting control based on a maintenance operation for maintenance by a maintainer, said maintenance control section including a maintenance operation section for accepting said maintenance operation, and a maintenance operation control section responsive to the acceptance of said maintenance operation by said maintenance operation section for temporarily placing said state retention section in said alarming state to cause said alarm section to issue an alarm.

4. The display device according to claim 1, wherein said anti-theft section further includes a maintenance control section for effecting control based on a maintenance operation for maintenance by a maintainer, said maintenance control section including a maintenance operation section for accepting said maintenance operation, a maintenance check section for issuing an alarm for maintenance check, and a maintenance operation control section responsive to the acceptance of said maintenance operation by said maintenance operation section for causing said maintenance check section to issue said alarm.

5. The display device according to claim 1, wherein said second power supply section includes a battery, and said anti-theft section further includes a maintenance control section for effecting control based on a maintenance operation for maintenance by a maintainer, said maintenance control section including a maintenance operation section for accepting said maintenance operation, a power supply voltage monitoring section for monitoring a power supply voltage supplied from said battery, and a maintenance operation control section responsive to the acceptance of said maintenance operation by said maintenance operation section for making a comparison between a predetermined reference voltage higher than the lower limit of the power supply voltage at which said anti-theft section is operable and said power supply voltage detected by said power supply voltage monitoring section to check battery power.

6. The display device according to claim 1, wherein said second power supply section includes a battery, and said anti-theft section further includes a maintenance control section for effecting control based on a maintenance operation for maintenance by a maintainer, said maintenance control section including a maintenance operation section for accepting said maintenance operation, a power supply voltage monitoring section for monitoring a power supply voltage supplied from said battery, and a maintenance operation control section responsive to the acceptance of said maintenance operation by said maintenance operation section for checking battery power based on said power supply voltage detected by said power supply voltage monitoring section, said maintenance operation control section temporarily placing said state retention section in said alarming state to cause said alarm section to temporarily issue an alarm when said maintenance operation control section judges that the battery power remains.

7. A display device comprising:

an image display section for presenting a display based on an image signal;

a first power supply section for supplying power to said image display section;

an anti-theft section for preventing said display device from theft; and a second power supply section provided independently of said first power supply section for supplying power to said anti-theft section, said anti-theft section including a vibration sensor for sensing a shake of said display device, a vibration detection section for making a comparison between an output level from said vibration sensor and a previously determined reference level to detect the presence or absence of a vibration, a state retention section for selectively retaining a cautionary state in which caution is taken against theft of said display device and an alarming state indicating that said display device is being stolen, said state retention section making a transition from said cautionary state to said alarming state when said vibration detection section detects a vibration, an alarm section for issuing an alarm when said state retention section is in said alarming state, and a control section for controlling said anti-theft section, based on an operation by an operator, said control section including an operation section for accepting the operation by the operator, a state operation delaying section for delaying information about the operation accepted by said operation section by a fixed time interval to reflect the information about the operation in said state retention section, a maintenance timing pulse generation section for generating a maintenance timing pulse having a predetermined pulse duration in response to the acceptance of the information about the operation by said operation section, and a maintenance operation control section for causing said alarm section to temporarily issue an alarm during an time interval between the generation of said maintenance timing pulse and the end of said pulse duration.

8. The display device according to claim 7, wherein said second power supply section includes a battery;

said control section further includes a power supply voltage monitoring section for monitoring a power supply voltage supplied from said battery; and said maintenance operation control section checks battery power based on said power supply voltage detected by said power supply voltage monitoring section during the time interval between the generation of said maintenance timing pulse and the end of said pulse duration, said maintenance operation control section causing said alarm section to temporarily issue an alarm when said maintenance operation control section judges that the battery power remains.

9. The display device according to claim 1, wherein said vibration sensor includes a cylindrical case, a sphere movably received in said case, and a piezoelectric element in a bottom portion of said case for converting the impact of said sphere caused by collision of said sphere against a side wall portion of said case into an electric signal.

10. The display device according to claim 7, wherein said vibration sensor includes a cylindrical case, a sphere movably received in said case, and a piezoelectric element in a bottom portion of said case for converting the impact of said sphere caused by collision of said sphere against a side wall portion of said case into an electric signal.

* * * * *